United States Patent [19]

Caratsch

[11] 4,055,688

[45] Oct. 25, 1977

[54] METHOD AND APPARATUS FOR APPLYING SYNTHETIC RESIN POWDER IN A GRATE-SHAPED COATING TO WEB MATERIAL

[76] Inventor: Hans-Peter Caratsch, Itenhardstrasse 16, 5620 Bremgarten, Switzerland

[21] Appl. No.: 686,141

[22] Filed: May 13, 1976

[30] Foreign Application Priority Data

Mar. 31, 1976 Switzerland ..... 4000/76
Mar. 31, 1976 Switzerland ..... 4001/76

[51] Int. Cl.[2] ..... B05D 5/00; B05D 1/00; B05D 7/00

[52] U.S. Cl. ..... 427/195; 101/170; 118/202; 118/211; 118/212; 118/221; 118/224; 427/197; 427/201; 427/203; 427/265

[58] Field of Search ..... 427/195, 197, 201, 203, 427/265; 118/202, 212, 224, 211, 221; 101/151, 152, 170, 181

[56] References Cited

U.S. PATENT DOCUMENTS

| | | | |
|---|---|---|---|
| 1,832,007 | 11/1931 | Eckland et al. | 118/212 X |
| 2,067,239 | 1/1937 | Mayo et al. | 427/203 X |
| 2,268,890 | 1/1942 | Mortensen | 427/203 X |
| 2,406,287 | 8/1946 | Grimshaw | 427/265 |
| 2,695,244 | 11/1954 | Fountain | 118/212 X |
| 2,729,193 | 1/1956 | Scholl | 118/202 |
| 3,313,270 | 4/1967 | Labombarde et al. | 118/202 X |
| 3,417,925 | 12/1968 | Krikorian | 118/202 X |
| 3,440,076 | 4/1969 | Vaurio | 427/197 X |
| 3,671,284 | 6/1972 | Uhrig | 118/202 X |
| 3,814,052 | 6/1974 | Caratsch | 118/202 X |

FOREIGN PATENT DOCUMENTS

| | | |
|---|---|---|
| 1,420,497 | 1/1976 | United Kingdom |

*Primary Examiner*—Ronald H. Smith
*Assistant Examiner*—Shrive P. Beck
*Attorney, Agent, or Firm*—Werner W. Kleeman

[57] ABSTRACT

A method of, and apparatus for, applying a synthetic resin or plastic powder in a grate-shaped coating to web material wherein an upper layer is formed so as to coincide with and lie upon a lower layer applied by a relief-like structured printing roll. The upper layer is also formed by a relief-like structure printing roll. The powder for both layers, during its transfer into the spaces of the rolls, is brought to its sinter temperature, whereas the web material, before forming the lower layer, is heated approximately to the plasticizing temperature of the powder for this layer. The powder piles of the upper layer are placed upon those of the lower layer directly after transferring the latter to the web material.

2 Claims, 2 Drawing Figures

METHOD AND APPARATUS FOR APPLYING SYNTHETIC RESIN POWDER IN A GRATE-SHAPED COATING TO WEB MATERIAL

BACKGROUND OF THE INVENTION

The present invention relates to a new and improved method of, and apparatus for, applying a synthetic resin or plastic powder in the form of a grate-shaped or raster-shaped coating to web material.

In Swiss patent publication 8058/68 there is disclosed apparatus having relief-like structured printing rolls for application of a synthetic resin powder in a grate-shaped coating to web material and based upon such apparatus there is also discussed a method for coating textile supports or underlayers with pulverulent plastic or synthetic resin. With the aid of this known apparatus and while using the disclosed method there are particularly fabricated reinforcement inserts or linings for garments with a grate-shaped coating of a heat sealable adhesive. Generally, the heat sealable adhesive is applied to the insert in a point raster or grating configuration, the soft textile handle being retained in the composite consisting of the insert and the top cloth. With the teachings of the aforementioned Swiss patent publication it is not always possible to attain the aforementioned results, particularly if the corresponding requirements continuously become greater.

More promising is another coating technique which has become known from German petty patent 7,211,197 which consists of a grate-shaped lower layer of heat sealable adhesive having a high melting viscosity and/or high melting point or high melting range and only a second upper layer seated on the base grating or raster and of lower melting viscosity and/or lower melting point or melting range. The grate-shaped lower layer can be produced at the fabric web, among other things, with the aid of an engraving roller, and the adhesive formed of powder or paste can be squeegeed into the grate-like engraved portions of the roller and from there transferred to the material or fabric web. Prior to applying the upper layer the grate-shaped material piles of the lower layer are sintered so that upon applying the upper layer by means of a squeegee roll or a roll coater such functions in the manner of the type or lettering during relief printing processes and thereby is able to partially take-up by light contact the thin layer of a heat sealable adhesive applied to the smooth roller and which has been liquified by a plasticizer or under the action of heat. The lower layer is thus applied according to the manner of an intaglio printing process, possibly a silk screen printing process. It is then converted by sintering into a type of relief printing matrix and the application of the upper layer occurs in the same manner in which during relief printing the printing matrix is imbued with the printing ink. This is of course only then possible if the material piles possess adequate strength, that is to say, are practically hardened (the expression "sintering" is then also used in the aforementioned German petty patent apparently in this sense). Without fulfilling this condition the lower layer, upon application of the upper layer, automatically would be smudged or smeared. But even if the material piles of the lower layer are sufficiently hardened the aforementioned procedures remain cumbersome and with regard to their practical application extremely questionable. Producing a homogeneous thin layer of a heat sealable adhesive upon a squeegee roll is already difficulty, particularly due to temperature effects. However, an even greater problem is the need to insure that the thin layer is released from the squeegee roll by the depositions of the lower layer in all instances, but only by such depositions and not for instance also by the material web. Moreover, it probably will be impossible to avoid deposition of the material for the upper layer — even if it can be released from the squeegee roll — directly at the material web.

SUMMARY OF THE INVENTION

Starting from the mentioned German petty patent the present invention contemplates a method for applying synthetic resin powder in a grate-shaped coating to web material composed of textile fibers wherein an upper layer is formed to coincide with a lower layer applied by means of a relief-like structured printing roll.

The present invention therefore has as one of its primary objects to devise a method of the previously mentioned character wherein it is possible to apply the lower layer and upper layer in a single working operation or step to the web material and thereby reliably insure that the upper layer, with respect to the raster or grating, is coincident upon the lower layer, i.e. is only applied thereto and not also directly to the web material.

Now in order to obtain this objective and other which will become more readily apparent as the description proceeds the method of the invention is manifested by the features that the upper layer is likewise formed by means of a relief-like structured printing roll or roller, that the powder for both layers is brought during its transfer in the roller structure spaces to its sinter temperature, whereas on the other hand the web material, prior to forming the lower layer, is heated approximately to the plasticizing temperature of the powder for such layer, and the powder piles of the upper layer are placed upon the powder piles of the lower layer directly after transferring the latter to the web material.

Furthermore, the invention relates to an apparatus having a relief-like structured printing roll or roller for carrying out the method. According to the invention there is provided a contact roll having two printing rolls each furnished with its own supply of powder and such are in coincidence with one another, on the one hand with regard to the grating or raster, and on the other hand, synchronously driven with the contact roll. Further, by means of roller heating devices the temperature of the printing rolls in each case can be adjusted to the sinter temperature of the powder delivered thereto and that of the contact roll essentially to the plasticizing temperature of the powder entrained by the first printing roll in its direction of rotation. The contact roll forms together with the second printing roll a larger roller gap or nip than with the first printing roll.

Such type device possesses a basic difference in contrast to the device which has become known as part of the art from Swiss patent publication 8058/68. With the known device the relief-like structured printing roll in any event, if it is not possible to work with its room temperature, by cooling can be held in a temperature state where the friability of the powder present in the supply container remains fully intact until it is transferred to the support. The temperature increase imparted by the support first leads to the powder losing its friable properties and converting into a material pile which is in a state of plastification. In contrast thereto, with the present invention sintering of the powder already takes place in the structure spaces. During its deposition upon the material web the synthetic resin or plastic so-to-speak is at the pre-stage of plastification and it attains the last-mentioned condition directly following the deposition. In other words, the homogeneous material piles are present at the moment of deposition and for the formation thereof it is not necessary to guide the material web over almost one-half of the circumference of the structured roll so as to bear thereagainst, in order to give the synthetic resin sufficient time to reach the plasticized condition.

Then if the material piles of the lower layer which are homogeneous immediately after their deposition come into contact with the powder quantities which likewise are already sintered and entrained in the structure spaces or voids of the second printing roll, then such powder quantities are withdrawn by the adhesive force of the plasticized material piles and due to their inherent momentary prevailing adhesive force from the structure spaces. Therefore in this case the material piles of the lower layer need not be completely set or hardened, quite to the contrary their plasticity is utilized in order to detach the synthetic resin or plastic from the second printing roll. Since the synthetic resin is thus applied with the aid of the second structured roll likewise in the form of a grating of raster and is placed in coincidence upon the lower layer, there is eliminated any smudging of the material web. Conversely, it is not necessary to fear any smudging of the second printing roll by the lower layer, since this roll, in comparison to the plastification temperature, has a relatively low temperature which prevents the sticking of the material of the lower layer to the second printing roll. Apart from the foregoing a slight contact of such roll or the powder entrained therein with the lower layer is adequate in order to produce the upper layer.

BRIEF DESCRIPTION OF THE DRAWINGS

The invention will be better understood and objects other than those set forth above, will become apparent when consideration is given to the following detailed description thereof. Such description makes reference to the annexed drawings wherein FIG. 1 schematically illustrates an apparatus for applying a synthetic resin powder in the form of a grate-shaped coating to web material as contemplated by the invention.

DETAILED DESCRIPTION OF THE PREFERRED EMBODIMENTS

Figure 1:
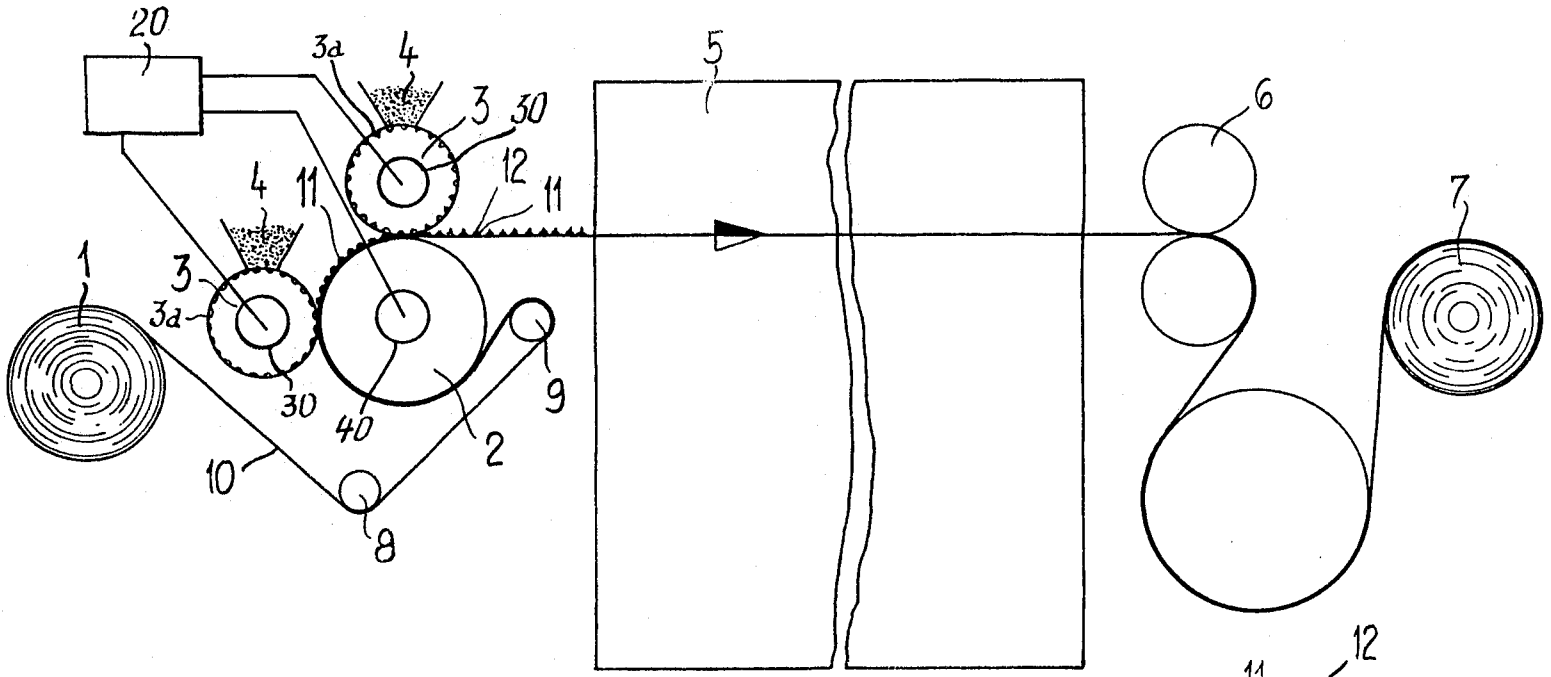

Describing now the drawings, the web material 10 withdrawn from a supply roll 1 arrives via the deflecting rolls 8 and 9 at a contact roll or roller 2. The payed-off web material 10 is trained about a considerable part of the outer surface or periphery of contact roll 2 as best seen by referring to FIG. 1. This contact roll 2 has operatively associated therewith the relief-like structured spot or printing rolls 3 having the relief structure of structured surface generally indicated by reference character 3*a.* These printing or pressure rolls 3 are each charged with powder from their own associated supply container 4. The first printing roll 3, considered with respect to the direction of rotation of the contact roll 2, deposits the material piles 11 of the lower layer. By means of the second printing roll 3 there is applied upon these material piles 11 the material piles 12 forming the upper layer. The thus completely charged web 10 then arrives in a gelation channel 5, thereafter at a smoothing- and cooling arrangement 6 and finally is rolled-up at a take-up roll 7 or equivalent structure. A suitable drive arrangement 20 serves to drive the printing rolls 3 such that the grating patterns thereof are in coincidence with one another and further that such printing rolls are rotating in synchronism with the contact roll 2. The schematically indicated roll heating devices 30 serve to maintain the temperature of the printing rolls 3 at the sinter temperature of the infed powder and the heating device 40 maintains the temperature of the contact roll 2 essentially at the plasticizing temperature of the powder entrained by the first printing roll 3 considered with respect to the direction of rotation of the contrast roll 2.

Figure 2:
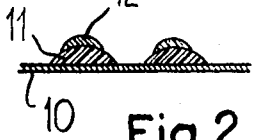
FIG. 2 is a fragmentary enlarged view showing the deposition of two piles of material on top of one another upon the material web.

In addition to the schematic showing of FIG. 1, the arrangement of FIG. 2, while using the same reference characters, shows a possible structure of the complete coating. In particular there will be recognized that even if the material piles of the lower layer, related to the surfaces of the web, possess a greater extent than those of the upper layer and thus than the structure spaces of the second printing roll, there cannot arise any smudging or smearing of the last-mentioned roller since the material piles of the lower layer with their segmented spheres can engage into the structure spaces or cavities of the second printing roll practically without contacting the latter.

By virtue of the previously discussed measures it is possible to carry out without any difficulty a double-coating in one working operation and under economical conditions. It is possible to attain with smaller weight an approximately 25% to 30% larger tear strength. To this end the lower layer for example can consist of a standard polyamide, for instance having a melt index of 10, whereas for the upper layer there can be employed the same, but if desired also a different material, for instance having a melt index of 145. The increased tear strength can be achieved with approximately 20% less coating weight. There can be applied for instance for the lower layer the highly viscous plastic with an application weight of approximately 10 to 12 grams and for the upper layer the lower viscous plastic with an application weight of about 5 to 7 grams. In any event it is possible to very accurately maintain the ratio between the application weights of the lower layer and the upper layer, and additionally the coating, both with regard to its thickness as well as also with regard to the raster or grating itself, is sufficiently uniform even when considered according to highest standards. By means of smaller application quantities there thus also can be obtained a softer handle of the insert. Moreover, by the selection of an appropriate material for the upper layer the insert can be appropriately coated with regard to particular requirements, for instance such that it can also be easily and with adequate strength connected with siliconized top cloths.

While there are shown and described present preferred embodiments of the invention, it is to be distinctly understood that the invention is not limited thereto, but may be otherwise variously embodied and practiced within the scope of the following claims. Accordingly,

What is claimed is:

1. A method for applying synthetic resin powder in the form of a substantially grate-shaped coating to web material, comprising the steps of: heating a web of material, applying a lower layer of the synthetic resin powder in the form of piles by means of a relief-like structured printing roll to the material web, applying an upper layer in the form of piles in coincidence to and upon the lower layer by means of a relief-like structured printing roll, bringing the powder of both layers during transfer thereof in the rolls to its sintering temperature, heating the web material prior to forming the lower layer approximately to the plasticizing temperature of the powder for this layer, and placing the powder piles of the upper layer upon the powder piles of the lower layer immediately after transferring the powder piles of the lower layer to the web material.

2. An apparatus for applying synthetic resin powder in the form of a substantially grate-shaped coating to web material, comprising means for feeding a web of material along a predetermined path of travel, a contact roll about which there is trained the web of material along its path of travel, a pair of printing rolls each having means defining a grate pattern and operatively associated with the contact roll, a separate powder supply means provided for each printing roll, the printing rolls being substantially coincident with respect to one another as concerns their grate patterns, means for driving the printing rolls in synchronism with the contact roll, roller heating means for adjusting the temperature of the printing rolls to the sintering temperature of the infed powder and the temperature of the contact roll essentially to the plasticizing temperature of the powder entrained by the first printing roll considered with respect to the direction of rotation of the contact roll, and wherein the contact roll together with the other printing roll defining the second printing roll forms a larger roller gap than the roller gap formed by the contact roll in conjunction with the first printing roll.

* * * * *